United States Patent [19]

Wescoat

[11] 4,094,451

[45] June 13, 1978

[54] LOTTERY TICKET DISPENSER FOR BREAK-RESISTANT WEB MATERIAL

[75] Inventor: George F. Wescoat, Manchester, N.H.

[73] Assignee: Granite State Machine Co., Inc., Manchester, N.H.

[21] Appl. No.: 738,726

[22] Filed: Nov. 4, 1976

[51] Int. Cl.[2] ..... B26F 3/00

[52] U.S. Cl. ..... 225/96; 83/176; 83/210; 225/104; 226/88

[58] Field of Search ..... 225/96, 103, 104, 94; 83/210, 212, 176, 443, 450; 226/88, 64

[56] References Cited

U.S. PATENT DOCUMENTS

| | | | |
|---|---|---|---|
| 1,843,161 | 2/1932 | Ingram | 225/104 X |
| 2,110,777 | 3/1938 | Streine | 83/450 X |
| 2,418,958 | 4/1947 | Stock | 225/104 |
| 3,145,890 | 8/1964 | Gordon et al. | 83/242 X |
| 3,282,486 | 11/1966 | DeMoss | 226/88 X |
| 3,552,616 | 1/1971 | Mason | 83/242 X |
| 3,894,669 | 7/1975 | Wescoat | 83/212 X |

*Primary Examiner*—Frank T. Yost
*Attorney, Agent, or Firm*—Pearson & Pearson

[57] ABSTRACT

A ticket dispenser automatically advances a continuous web of lottery tickets, one ticket length, halts the advance, and severs the end most ticket to drop into a delivery chute upon actuation. The dispenser is capable of handling ticket webs which are difficult to tear or have poor perforations, by pre-breaking the web along its transverse lines of perforation, in opposite angular directions by means of a set of three cylindrical rolls, and by moving a breaker bar upwardly into a slot between an inclined bed plate and a horizontal bed plate to slice each successive, prebroken perforated line. The printed indicia can thus be on the upper surface of the web and the tickets delivered face-up.

6 Claims, 4 Drawing Figures

Fig. 1.
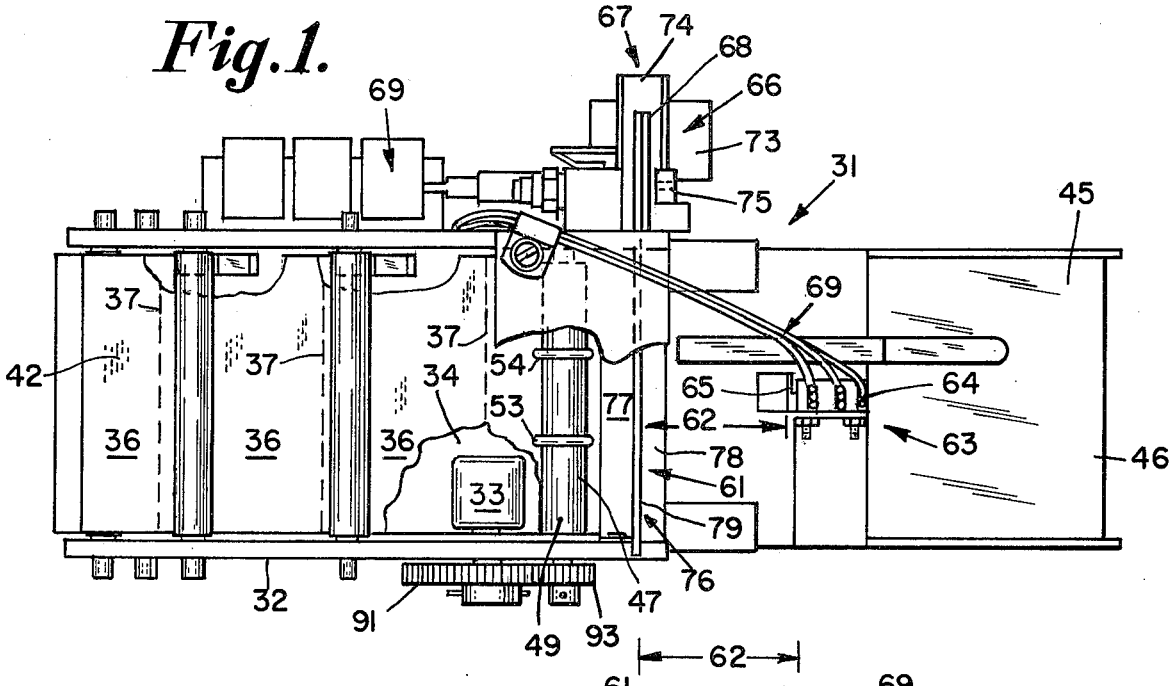
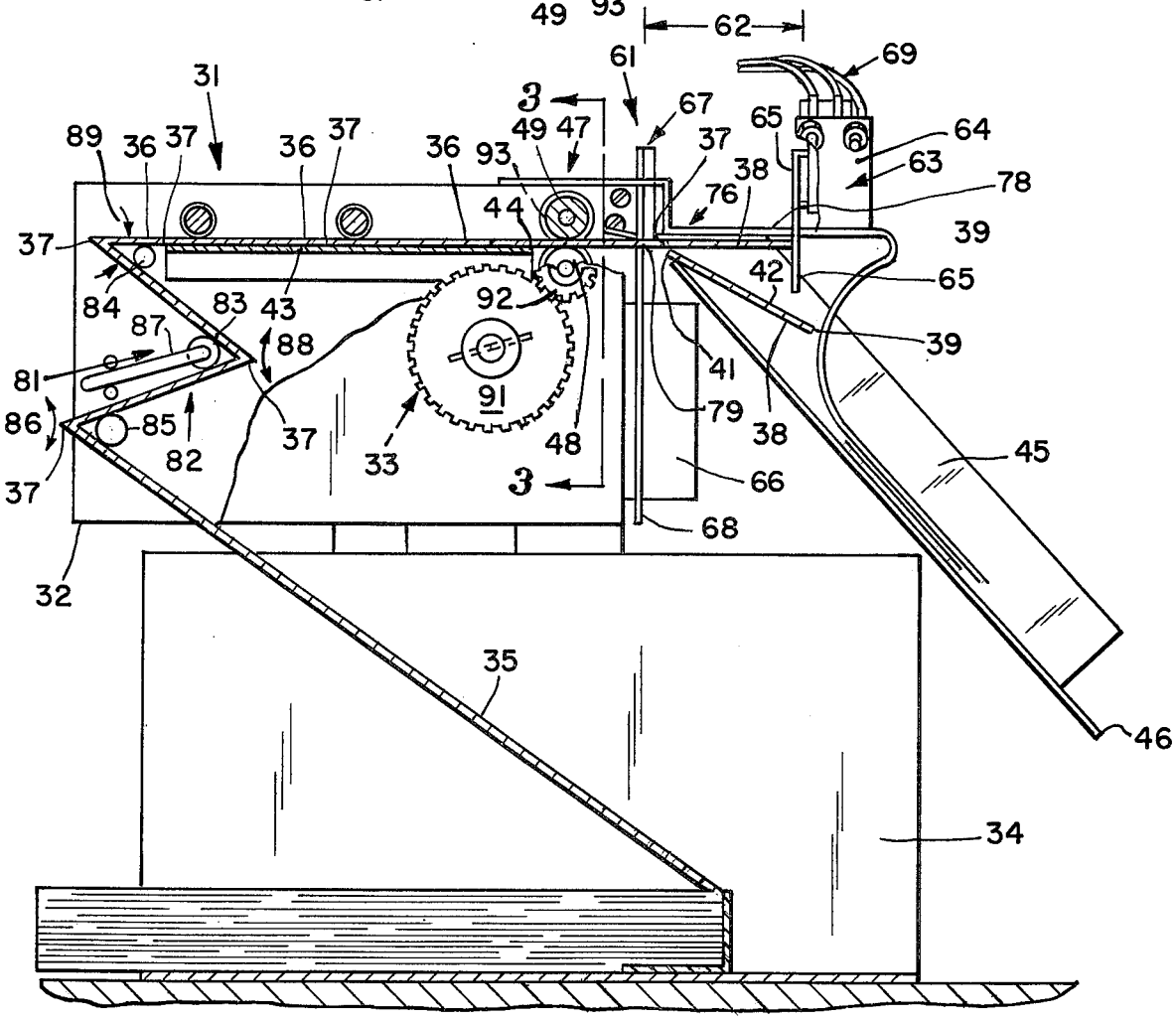
Fig. 2.

LOTTERY TICKET DISPENSER FOR BREAK-RESISTANT WEB MATERIAL

BACKGROUND OF THE INVENTION

The dispensing of individual sheets from a continuous web of such sheets presents a multitude of problems, depending on the rigidity or limpness of the material of the web, the importance of any accumulated error in the successive lines of severance and the intrinsic valve of the individual sheets themselves.

Lottery tickets are even more valuable potentially than for example railroad or theatre tickets, postage stamps, paper toweling or the like and must be carefully severed exactly on the lines of perforation while being carefully protected from unauthorized access, vandalization or fraudulent marking.

In U.S. Pat. No. 3,612,372 to Richer of Oct. 12, 1971 and U.S. Pat. No. 3,734,261 to Richer of May 22, 1973, the automatic ticket dispensers include either a stationary tear bar for enabling the customer to tear off his ticket or an upward moving blade for cutting off each successive ticket. However, registration and accurate severance are obtained by the use of registration holes in the fan-folded continuous web and registration pin chains for advancing the web.

In U.S. Pat. No. 3,894,669 to Wescoat of July 15, 1975, an automatic ticket dispenser is disclosed in which registration holes and pins are eliminated. The web is advanced by the nip of a knurled lower roll and a friction ring upper roll, there being a pair of ticket bowing rings on the upper roll which bow the tickets down into slots in a stationary bed plate. The bowed end most ticket thus is rigidified, as it spans the gap to a stop means, so that a down moving blunt breaker bar can deliver a karate blow at the line of perforation to separate the ticket.

The above mentioned dispensers of the prior art have been found to be most satisfactory for use with ticket material of relatively high cost, such material having an inherent ability to span a gap in self-supporting horizontal position and to present enough resistance to a down moving bar to cleanly break at the perforated line of connection. It will be understood that if there are no registration pins and holes, and if a ticket is broken off elsewhere than at the exact line of perforation, a friction feed may accumulate the error and may cause all succeeding tickets to be inaccurately separated from the web. Thus some lottery customer might pay for his ticket and obtain only a half ticket or a mutilated ticket and thereby lose his right to claim the million dollar, or other, prize.

SUMMARY OF THE INVENTION

In the lottery ticket dispenser of this invention, the registration holes and pins have been eliminated, friction feed rolls are used to advance the end most ticket of the web across a gap to a stop in the path of the leading edge and a limit switch at the stop halts the feed rolls and energizes the circuit to the breaker bar.

There is no need to turn the severed ticket over in the delivery chute to face upwardly because the printed indicia is face up in the web and the end most ticket is severed on its perforated line by an upmoving bar entering a slot in bed plates above the path of the ticket at the breaker bar station.

Whether the web material is unduly flimsy or unduly tough, or is of material difficult to tear, the breaker bar slices the ticket line cleanly and accurately because the web has been pre-broken and pre-folded by a set of three cylindrical rolls on each successive perforated line through at least a 90° angle as it approaches the breaker bar station.

In this invention also a pair of driven feed rolls are used, the lower feed roll being smooth faced with a pair of smoothly curved annular grooves, each of arcuate cross section in the central portion and the upper feed roll having a pair of rubber friction rings, each of arcuate cross section, each cooperating with one of the grooves to form a pair of axially extending bows in the end most tickets while not dragging on either upper or lower surface of the ticket. The smooth circumferential surfaces, proximate each opposite end of the feed rolls form a pressure nip for advancing the endmost tickets.

The slotted upper bedplates prevent the tickets from turning over under the upward impact of the breaker bar and the absence of a knurled feed roll permits the surface of the tickets to be free of embossment. Most importantly, even with webs of difficult to tear material and when the perforations therein are poorly formed, the pre-folded perforated lines are accurately severed by the apparatus of the invention.

BRIEF DESCRIPTION OF THE DRAWINGS

FIG. 1 is a plan view of a dispenser constructed in accordance with the invention;

FIG. 2 is a side elevational view of the apparatus shown in FIG. 1 with parts broken away;

DESCRIPTION OF A PREFERRED EMBODIMENT

Figure 3:
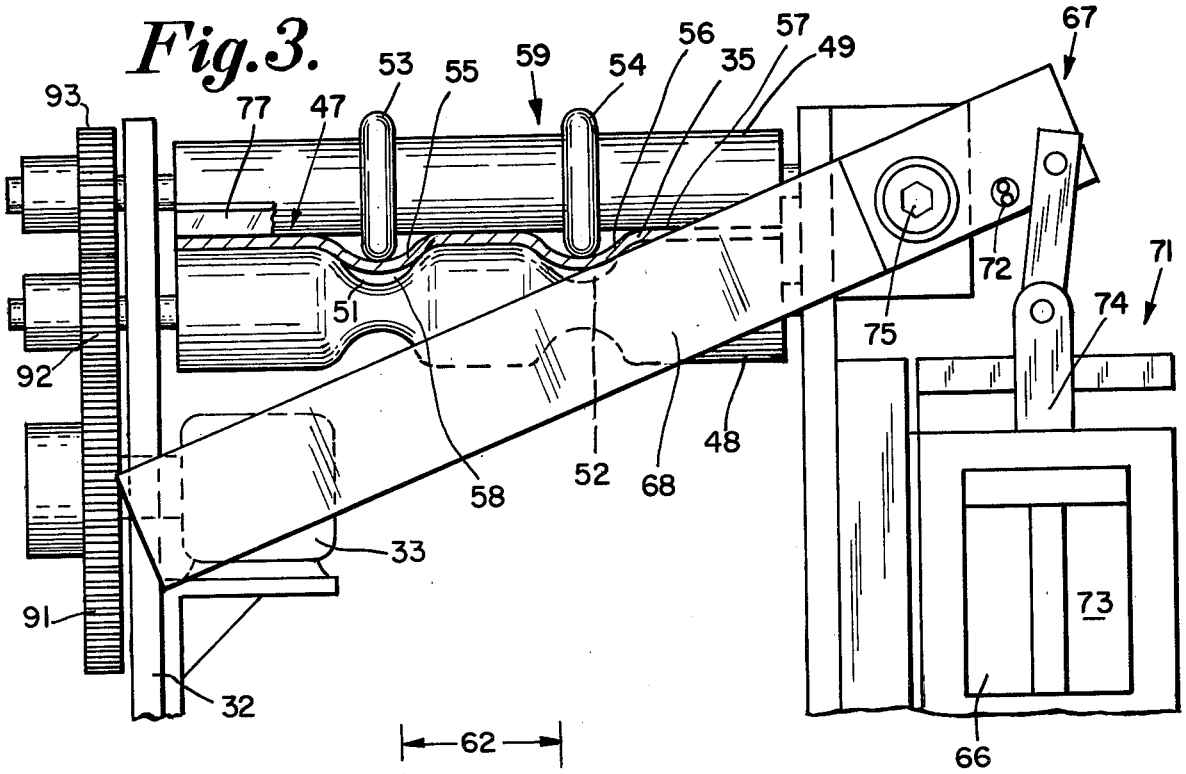
FIG. 3 is an enlarged, fragmentary front elevation showing the up-moving breaker bar, bowing rolls and a portion of the upper bed plate
Figure 4:
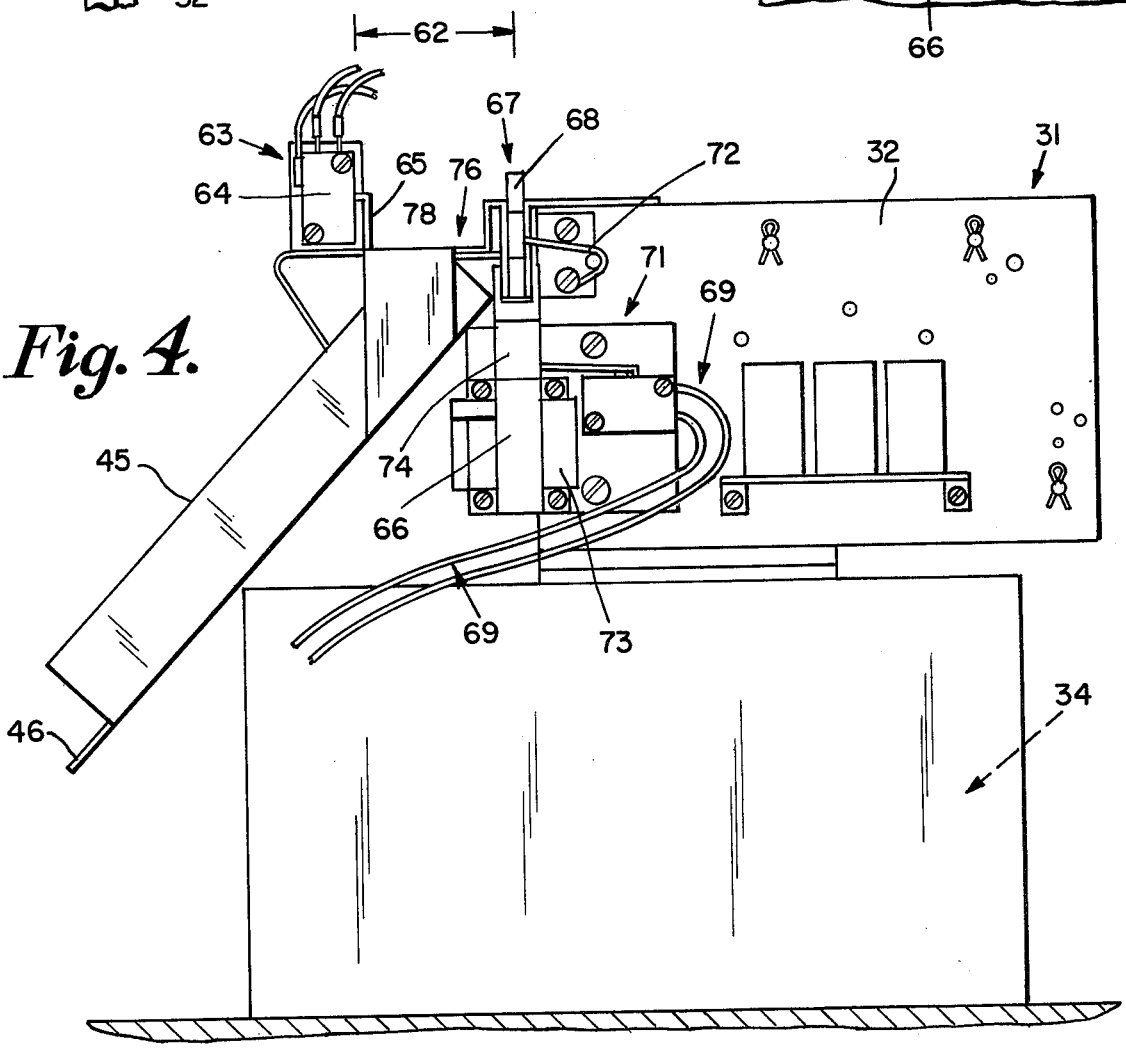
FIG. 4 is a side elevational view of the apparatus showing the solenoid for actuating the up-moving breaker bar, limit switches and circuit components.

The ticket dispenser apparatus 31 of the invention is contained in a framework 32 which fits within the main housing of a conventional lottery ticket dispenser, such as shown in the above mentioned U.S. Pat. Nos. 3,612,372, 3,734,261 and 3,894,669 all now well known in the art. The mechanism is actuated by a commercially available note acceptor, not shown, which closes an electric circuit to the feed roll motor 33 upon acceptance of the customer's paper money.

The framework 32 includes a supply compartment 34 for a continuous web 35 of individual lottery tickets 36 separated from each other by perforated lines 37, the web 35 being preferably fan folded as shown. Each successive leading, or endmost, ticket 38 has a leading edge 39, a trailing edge portion 41 and has printed indicia 42 on the upper surface, the web being advanced with the printed side up. The framework 32 also includes a horizontal platform 43 with a forward edge 44.

A ticket delivery chute 45 is provided having a terminal end 46 extending outside the main housing so that individual tickets separated from web 35 and dropping down the chute may be picked up by the purchaser.

Powered friction feed mechanism 47 includes a pair of smooth faced rolls 48 and 49, the lower roll 48 preferably being of metal and having a pair of spaced apart, centrally located, annular grooves 51 and 52 extending therearound, each groove being smoothly curved as indicated in FIG. 3, and of arcuate cross section. The upper roll 49 is preferably of rubber and includes a pair of friction rings 53 and 54 sleeved thereon, each ring being of greater outside diameter than the outside diameter of upper roll 49 so that it cooperates with one of the grooves 51 or 52 to extend down thereinto and thereby form an axially extending bow, or crease, 55 and 56, in each ticket 36 passing through the pressure nip 57 of the rolls. The friction rings 53 and 54 may be so dimensioned as to also form a pressure nip with the surface of their respective grooves 51 or 52 but it is preferred that there be a clearance as at 58 so that the nip 57 advances the tickets while the ticket bowing means 59 performs only the bowing, and ticket rigidifying, function.

It will be seen that the ticket bowing means 59, creates the double bows 55 and 56 in each endmost, or leading, ticket 38 as the remainder of the web is advanced along its path from the supply compartment 34, through the friction feed nip 57 and bowing means 59 and is thus self-supporting to span the breaker bar station 61, and the gap 62 over to the stop means 63, without collapse.

The stop means 63 comprises a limit switch 64 having a depending switch arm 65 in the path of the leading edge 39 of each successive endmost ticket 38 when it has spanned the gap 62. Actuation of limit switch 64 also closes electric circuit means 69 to the solenoid 66 of the breaker bar means 67 to actuate the breaker bar 68.

The solenoid 66 is included in the power means 71 which actuates the breaker bar 68, the bar 68 being normally poised below, and out of, the path of the endmost tickets 38 and held in that position by springs 72. Upon energization of solenoid coil 73, by circuit means 69, the solenoid plunger 74 is drawn downwardly into coil 73, thereby moving the bar on its pivot 75 in an upward path at station 61 to slice the ticket at that station along its perforated line 37 to separate the ticket from the web.

Cooperating with the upward moving breaker bar 68 is bed plate means 76 extending over the path of the web 35 and its endmost ticket 38, to span the gap 62 at breaker bar station 61. Bed plate means 76 includes an inclined bed plate 77 in advance of the breaker bar station 61 and a horizontal bed plate 78 in rear of the breaker bar station 61, the latter plate extending across gap 62 but being spaced from the inclined plate 77 to form a breaker bar slot 79. The pair of bed plates enable the breaker bar to obtain a clean slicing cut along the perforated line 37, without lifting the ticket, and the inclined plate 77 guides the double-bowed, leading edge 39 of each successive endmost ticket, emerging from the nip 57, down to the horizontal level of plate 78.

Because the ticket web 35 may be unusually tear resistant and may have poorly formed, incomplete perforations along the lines 37, pre-breaking means 81 is provided comprising a set 82 of three cylindrical rolls 83, 84 and 85, mounted along the path of continuous web 35 between supply compartment 34 and breaker bar station 61. The web 35 is thus guided from compartment 34 around roll 82 to pre-break, or pre-fold, the web through an inside angle of at least 120°, indicated at 86, along its perforated lines 37. The roll 83 is supported on the U-shaped element 87, for slight translatory movement, and guides the web 35 through an outside angle of at least 120° indicated at 88. Having thus been pre-broken first in one angular direction on line 37 at roll 82 and then in the opposite angular direction on line 37 at roll 83, the web is again pre-broken on line 37 at roll 84 through an inside angle of about 120° indicated at 89.

The intermeshed drive gears between motor 33 and feed rolls 48 and 49 are designated 91, 92 and 93.

I claim:

1. A lottery ticket dispenser of the type having a continuous web of individual lottery tickets, separated by perforated lines, guided along a path from a supply compartment to a breaker bar station proximate a delivery chute, said dispenser having friction feed mechanism advancing said web along said path, ticket bowing means on said path, just in advance of said breaker bar station, for rigidifying each successive endmost ticket to span said breaker bar station, and stop means including a limit switch in the path of the leading edge of each said successive endmost ticket for stopping said feed mechanism when closed by contact with said leading edge, characterized by breaker bar means including a pivoted breaker bar normally poised out of said path at said breaker bar station; power means for moving said bar in an upward path to separate each endmost ticket engaging said stop means along its perforated line of connection to said web and bed plate means extending over the path of said unsupported web at said station including a pair of bed plates separated by a slot in the path of said upward moving breaker bar, the perforated line of connection of each successive endmost ticket being located in said slot when the leading edge of said ticket is in engagement with said stop to cooperate with said bar in separating said endmost ticket despite flimsiness of said web and;

pre-breaking means comprising a set of three cylindrical rolls mounted along said path in advance of said breaker bar station for pre-folding each said ticket first in one direction and then in the opposite direction along its perforated line of connection to said web;

said friction feed mechanism and said ticket bowing means comprises a pair of smooth faced rolls forming a pressure nip at each opposite end thereof, the lower roll having a pair of annular, spaced apart centrally located grooves each of arcuate cross section and the upper roll having a pair of annular, spaced apart centrally located friction rings of yieldable rubber like material, each ring being arranged to distort the adjacent portion of a ticket down into one of said grooves to bow the same in a smooth curved cross section.

2. Apparatus for dispensing one lottery ticket at a time from a web of such tickets connected to each other by transverse, perforated lines, said apparatus comprising:

friction feed means, including a pair of powered feed rolls, for advancing said web along a path from a web supply compartment, through a breaker bar station, across a gap, to a stop in the path of the leading edge;

said feed rolls having smooth circumferential surfaces proximate each opposite end thereof, for advancing said web and having smoothly curved ticket bowing surfaces of arcuate cross section centrally of said rolls for transversely bowing said web;

bed plate means extending across said gap, above the path of said web, said bed plate means having a slot therein at said breaker bar station;

a pivoted breaker bar normally poised below the path of said web, but movable upwardly at said station to separate each successive endmost ticket from said web while passing through said bedplate slot, and electric circuit means including a limit switch in the path of the leading edge of each successive endmost ticket at said stop, to stop said feed rolls and an electric motor for actuating said breaker bar when said feed rolls and web are stopped.

3. Apparatus as specified in claim 2 plus pre-breaking means comprising a set of three cylindrical rolls mounted along the path of said web, in rear of said supply compartment and in advance of said feed rolls, for pre-folding each successive ticket in said web on its perforated fold line first in one angular direction and then in the opposite angular direction, through an angle of at least 90°.

4. Apparatus as specified in claim 2 wherein said ticket bowing means comprises a lower said feed roll with a pair of spaced apart, centrally located smoothly curved annular grooves, each of arcuate cross section, and an upper said feed roll with a pair of spaced apart, centrally located, rubber rings of enlarged diameter, each of arcuate cross section, each said ring cooperating with one of said grooves to bow each ticket passing through the nip of said rolls.

5. Apparatus as specified in claim 2 wherein said bed plate means includes a horizontal bed plate in rear of said slot in parallelism with the path of said web and an inclined bed plate in advance of said slot inclined downwardly toward said web path, said inclined plate guiding the leading edge of said web downwardly to the level of said horizontal plate of said bed plate means despite the transverse bows therein.

6. A combination as specified in claim 5 wherein:

said apparatus includes a delivery chute and said horizontal plate of said bed plate means, in rear of said slot, includes a downwardly and inwardly, curved integral, terminal portion out of the path of the leading edge of said endmost ticket but adapted to guide each successive, severed endmost ticket down said delivery chute without said ticket being overturned.

* * * * *